US011938370B2

(12) United States Patent
Petersen

(10) Patent No.: US 11,938,370 B2
(45) Date of Patent: Mar. 26, 2024

(54) EXERCISE DEVICE AND METHODS

(71) Applicant: Justin Petersen, Lakeside, CA (US)

(72) Inventor: Justin Petersen, Lakeside, CA (US)

( * ) Notice: Subject to any disclaimer, the term of this patent is extended or adjusted under 35 U.S.C. 154(b) by 0 days.

(21) Appl. No.: 18/154,724

(22) Filed: Jan. 13, 2023

(65) Prior Publication Data

US 2023/0166153 A1 Jun. 1, 2023

Related U.S. Application Data

(63) Continuation of application No. 17/138,474, filed on Dec. 30, 2020, now Pat. No. 11,565,150, which is a continuation of application No. 16/044,367, filed on Jul. 24, 2018, now Pat. No. 10,881,898.

(60) Provisional application No. 62/536,900, filed on Jul. 25, 2017.

(51) Int. Cl.

| | |
|---|---|
| ***A63B 22/20*** | (2006.01) |
| ***A63B 21/00*** | (2006.01) |
| ***A63B 21/068*** | (2006.01) |
| ***A63B 22/16*** | (2006.01) |
| ***A63B 23/02*** | (2006.01) |
| ***A63B 23/12*** | (2006.01) |

(52) U.S. Cl.

CPC ..... *A63B 22/203* (2013.01); *A63B 21/0004* (2013.01); *A63B 21/068* (2013.01); *A63B 21/4035* (2015.10); *A63B 22/20* (2013.01); *A63B 23/1236* (2013.01); *A63B 21/4034* (2015.10); *A63B 22/16* (2013.01); *A63B 23/0211* (2013.01); *A63B 23/0216* (2013.01); *A63B 23/0233* (2013.01); *A63B 2208/0219* (2013.01); *A63B 2208/0295* (2013.01)

(58) Field of Classification Search

CPC . A63B 22/203; A63B 21/0004; A63B 21/068; A63B 21/4035; A63B 22/20; A63B 23/1236; A63B 21/4034; A63B 22/16; A63B 23/0211; A63B 23/0216; A63B 23/0233; A63B 2208/0219; A63B 2208/0295

See application file for complete search history.

(56) References Cited

U.S. PATENT DOCUMENTS

| | | | | | |
|---|---|---|---|---|---|
| 2,829,891 | A * | 4/1958 | Ludwig | A63B 22/16 | 482/146 |
| 2,829,892 | A * | 4/1958 | Ludwig | A63B 22/16 | 482/146 |
| 3,630,540 | A * | 12/1971 | Smith | A63B 22/16 | 482/146 |
| 3,895,794 | A * | 7/1975 | England | A63B 22/16 | 482/146 |
| 4,601,469 | A * | 7/1986 | Sasser, Jr. | A63B 22/16 | 482/146 |
| 4,826,159 | A * | 5/1989 | Hersey | A63B 26/003 | 482/146 |

(Continued)

*Primary Examiner* — Garrett K Atkinson

(74) *Attorney, Agent, or Firm* — Knobbe Martens Olson & Bear LLP

(57) ABSTRACT

Disclosed is an exercise device having a platform and a roller. The platform has a surface sized and shaped to support a body part of a user and a pair of handles. The roller is coupled to the platform and configured to rotate relative to the platform. The platform is configured to translate in a first direction when the roller rotates in a first direction of rotation and translate in a second direction when the roller rotates in a second direction of rotation.

21 Claims, 5 Drawing Sheets

(56) References Cited

U.S. PATENT DOCUMENTS 4,911,440 A * 3/1990 Hyman ..... A63B 22/16 482/146
5,062,630 A * 11/1991 Nelson ..... A63C 17/014 482/41
5,125,880 A * 6/1992 Peters ..... A63B 22/16 482/79
5,152,691 A * 10/1992 Moscarello ..... A63B 22/16 482/146
5,545,115 A * 8/1996 Corcoran ..... A63B 22/16 482/146
5,891,002 A * 4/1999 Maki ..... A63B 22/16 482/79
5,897,474 A * 4/1999 Romero ..... A63B 22/14 482/79
6,017,297 A * 1/2000 Collins ..... A63C 17/24 482/146
6,095,348 A * 8/2000 Karashima ..... A47F 5/103 211/175
6,267,394 B1 7/2001 Bouden
6,457,731 B1 10/2002 Paranto
6,561,530 B2 5/2003 Carbonero
D489,423 S * 5/2004 Fan ..... D21/688
6,916,276 B1 * 7/2005 Robinson ..... A63B 69/0093 482/80
D521,708 S 5/2006 Obbitts
7,134,990 B2 * 11/2006 Wischusen ..... A63B 21/0004 441/74
7,213,819 B2 * 5/2007 Carbonero ..... A63C 17/26 280/32.6
D564,604 S * 3/2008 Mikail ..... D21/688
D567,887 S 4/2008 Deluise
7,357,767 B2 4/2008 Tsai
7,479,097 B2 * 1/2009 Rosborough ..... A63B 22/203 482/146
7,594,878 B1 * 9/2009 Joannou ..... A61H 1/005 482/54
7,681,248 B2 * 3/2010 Legenstein ..... A63C 17/0026 2/24
7,811,217 B2 * 10/2010 Odien ..... A63C 17/12 482/34
7,942,797 B1 * 5/2011 Canton ..... A63B 26/003 482/146
8,012,067 B2 * 9/2011 Joannou ..... A61H 1/005 482/54
D704,786 S * 5/2014 Tang ..... D21/765
8,721,507 B2 * 5/2014 Blancher ..... A63B 21/4013 482/121
8,899,604 B2 * 12/2014 Orenstein ..... A63C 17/0033 280/200
8,936,263 B2 * 1/2015 Rawlins ..... A63C 17/0093 280/87.042
8,936,539 B2 1/2015 Richard
9,101,525 B2 * 8/2015 Maw ..... A61H 23/0263
9,149,408 B2 10/2015 Karlovich
9,211,896 B1 12/2015 Berghash
9,376,155 B2 * 6/2016 Ying ..... B62K 11/007
9,387,363 B1 * 7/2016 Polinsky ..... A63B 26/003
9,421,835 B2 8/2016 Kao
9,533,191 B2 1/2017 Carbone
9,566,468 B2 * 2/2017 Crist ..... A63B 22/16
9,616,294 B2 * 4/2017 Kramer ..... A63C 17/24
9,643,077 B2 * 5/2017 Bigler ..... A63C 17/014
9,707,470 B2 * 7/2017 Ma ..... B62K 1/00
D810,218 S * 2/2018 Huang ..... D21/760
10,010,784 B1 * 7/2018 Doerksen ..... A63C 17/0046
10,052,520 B2 * 8/2018 Kramer ..... A63B 21/4043
10,071,303 B2 * 9/2018 Pikulski ..... A63C 17/262
10,220,245 B1 3/2019 Halen
D847,285 S * 4/2019 Ma ..... D21/765
10,343,051 B2 * 7/2019 Doerksen ..... G05D 1/0891
D858,366 S 9/2019 VanAusdall
10,449,436 B2 * 10/2019 Duff ..... A63C 17/26
2002/0140200 A1 * 10/2002 Paranto ..... A63B 22/0605 280/87.021
2007/0158117 A1 * 7/2007 Alexander ..... B60L 50/52 180/21
2010/0049105 A1 * 2/2010 Joannou ..... A63B 22/0235 601/49
2010/0330876 A1 * 12/2010 Carlson ..... A63H 17/26 29/428
2011/0251033 A1 * 10/2011 Blancher ..... A63B 22/16 482/123
2012/0007331 A1 * 1/2012 Hsieh ..... A63C 17/017 280/221
2012/0256386 A1 10/2012 Benarrouch
2013/0184131 A1 * 7/2013 Doyle ..... A63B 21/00 482/139
2013/0238231 A1 * 9/2013 Chen ..... B60L 15/20 701/124
2015/0075575 A1 3/2015 Karlovich
2016/0129963 A1 * 5/2016 Ying ..... B62D 51/02 180/6.5
2016/0136508 A1 * 5/2016 Bigler ..... B62K 15/00 180/181
2016/0325801 A1 * 11/2016 Artemev ..... B60L 50/64
2017/0056756 A1 * 3/2017 Pikulski ..... A63C 17/016
2017/0120139 A1 * 5/2017 Ma ..... A63C 17/12
2018/0036625 A1 * 2/2018 Duff ..... A63C 17/26
2018/0133553 A1 * 5/2018 Kramer ..... A63C 17/265
2019/0070486 A1 * 3/2019 Shi ..... A63C 17/12

* cited by examiner

EXERCISE DEVICE AND METHODS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application is a continuation application of U.S. patent application Ser. No. 17/138,474, filed Dec. 30, 2020, which issues on Jan. 31, 2023 as U.S. Pat. No. 11,565,150, and entitled "EXERCISE DEVICE AND METHODS," and which is a continuation application of U.S. patent application Ser. No. 16/044,367, filed Jul. 24, 2018, which issued on Jan. 5, 2021 as U.S. Pat. No. 10,881,898, and entitled "EXERCISE DEVICE AND METHODS," which claims benefit under 35 U.S.C. 119(e) to U.S. Provisional App. No. 62/536,900 filed on Jul. 25, 2017, the entirety of which is hereby incorporated by reference.

BACKGROUND

Field

This invention relates to exercise devices, and more particularly, relates to rolling exercise devices.

Description of the Related Art

Exercise equipment includes systems and devices that allow users to improve physical fitness by performing a physical activity. Exercise devices are available for a variety of different uses for a variety of different body parts. Certain exercise may allow a user to work toward fitness related goals, including strength, conditioning, and flexibility.

SUMMARY

In a first aspect, an exercise device comprises a platform having a surface sized and shaped to support a body part of a user and a pair of handles. The pair of handles having a first handle at least partially defined by a first opening in the platform and configured to be gripped in use and a second handle at least partially defined by a second opening in the platform and configured to be gripped in use. The exercise device further having a roller coupled to the platform and configured to rotate relative to the platform. The platform being configured to translate in a first direction when the roller rotates in a first direction of rotation and translate in a second direction when the roller rotates in a second direction of rotation.

In a second aspect, an exercise device comprises a platform having a surface sized and shaped to receive a body part of a user and at least one handle configured to be gripped in use. The exercise device further has a roller coupled to the platform and configured to rotate relative to the platform. The roller having a tapered portion. The platform is configured to translate in a first direction when the roller rotates in a first direction of rotation and to translate in a second direction when the roller rotates in a second direction of rotation.

In a third aspect, and exercise device comprises a roller and a platform supported above the roller. The platform is configured to support at least a body part of a user above the roller while the roller rolls across a surface. The platform is further configured to tilt fore and aft while the roller rolls across the surface.

BRIEF DESCRIPTION OF THE DRAWINGS

The features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will now be described with additional specificity and detail through use of the accompanying drawings.

DETAILED DESCRIPTION

The following detailed description is directed to certain specific embodiments. The invention(s) disclosed herein, however, can be embodied in a multitude of different ways as defined and covered by the claims. In this description, reference is made to the drawings, wherein like parts are designated with like numerals throughout. The features, aspects and advantages of the present invention will now be described with reference to the drawings of several embodiments that are intended to be within the scope of the development herein disclosed. These and other embodiments will become readily apparent to those skilled in the art from the following detailed description of the embodiments having reference to the attached figures, the invention not being limited to any particular embodiment(s) herein disclosed.

Figure 1:
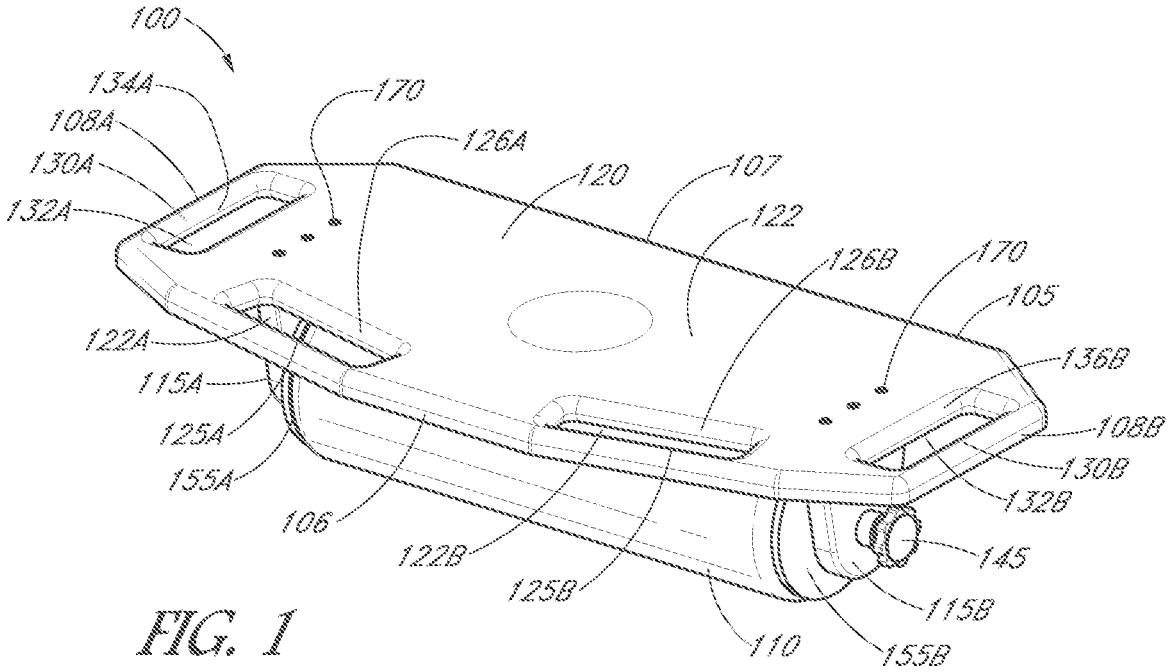
FIG. 1 is a perspective view of an exercise device according to a preferred embodiment of the present invention.
Figure 2:
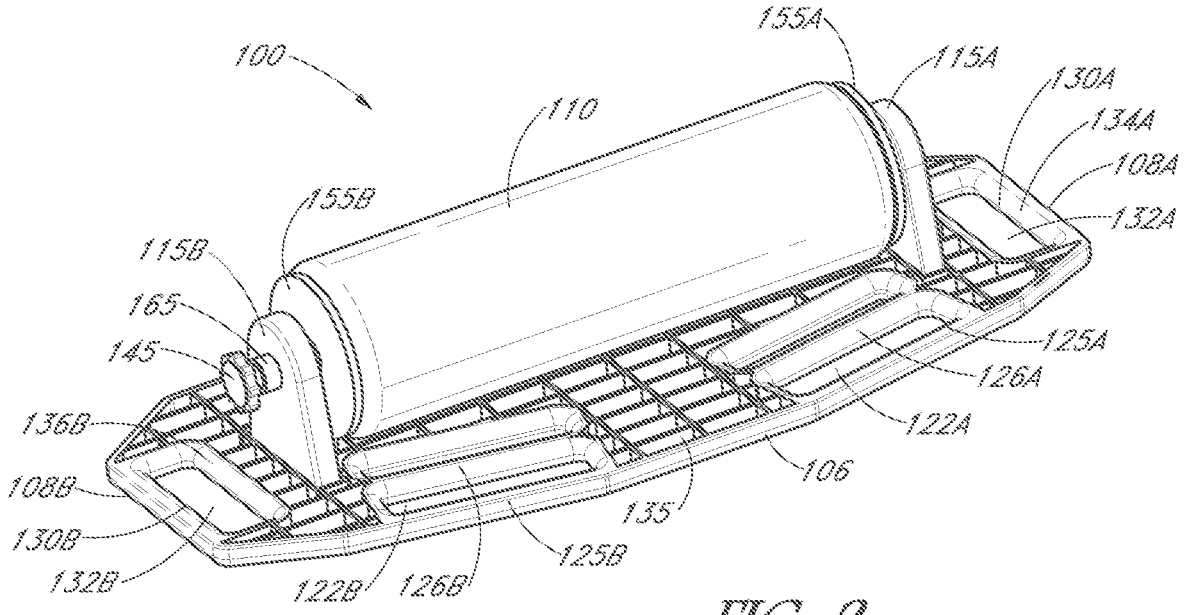
FIG. 2 is a bottom perspective view of the exercise device of FIG. 1.
Figure 3:
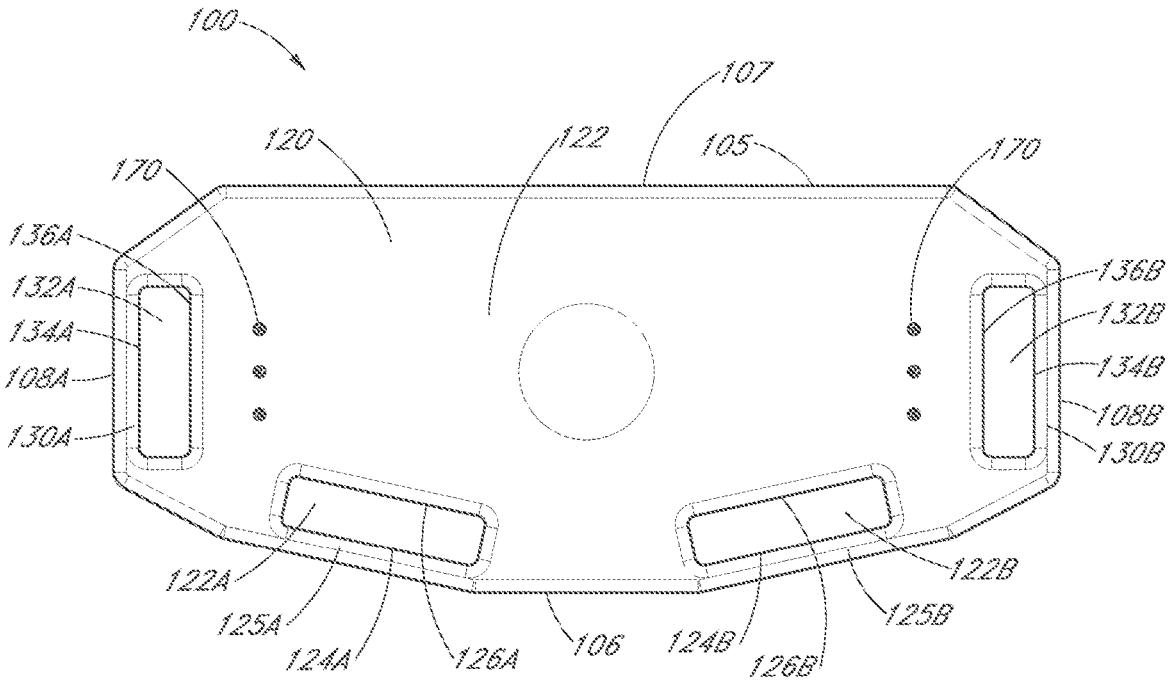
FIG. 3 is a top view of the exercise device of FIG. 1.
Figure 4:
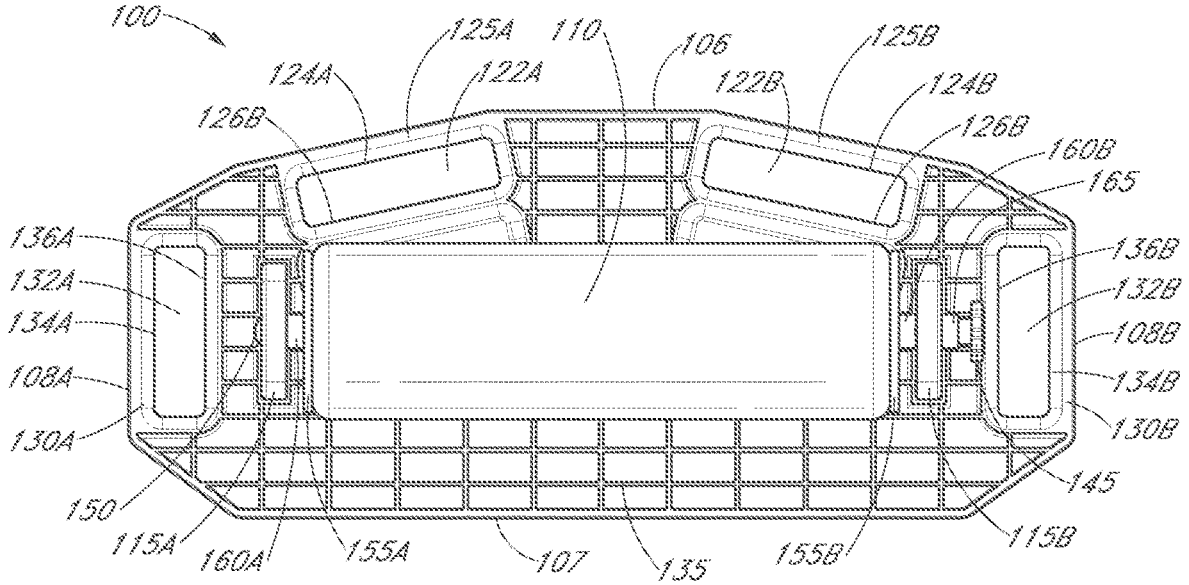
FIG. 4 is bottom view of the exercise device of FIG. 1.
Figure 7:
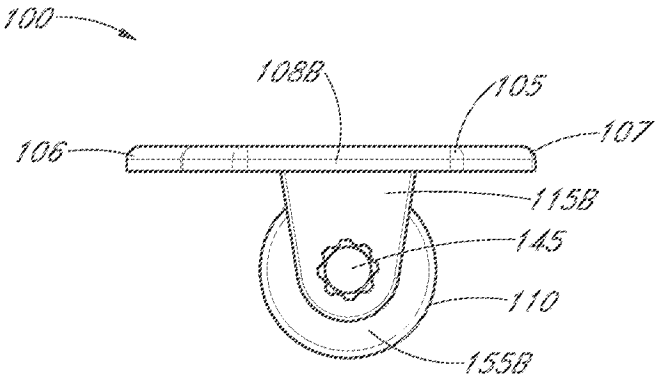
FIG. 7 is a side view of the exercise device of FIG. 1.
Figure 8:
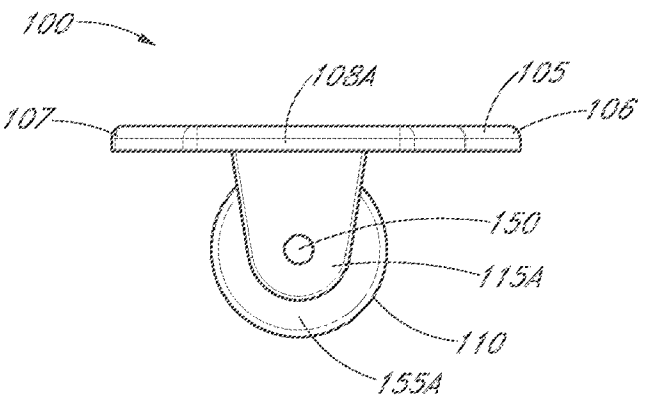
FIG. 8 is a side view of the exercise device of FIG. 1.
Figure 5:
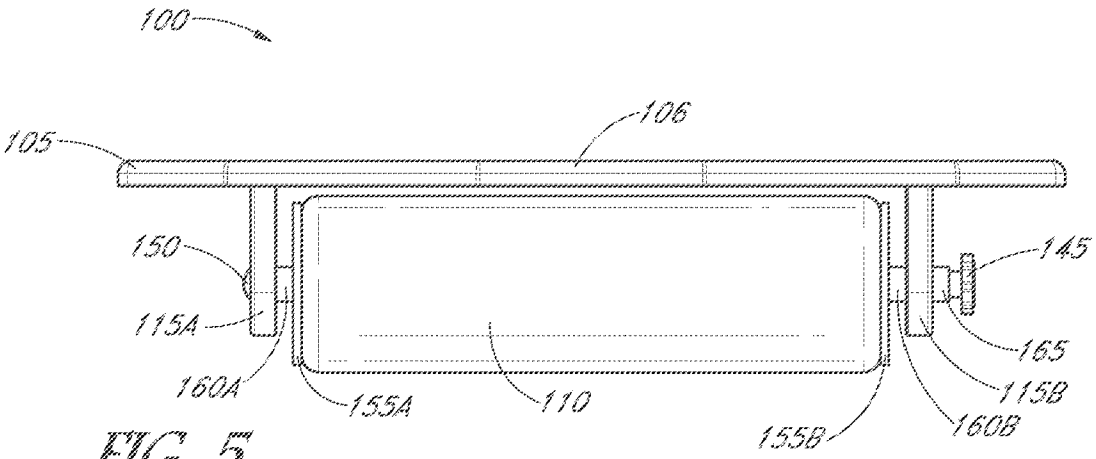
FIG. 5 is a front view of the exercise device of FIG. 1.
Figure 6:
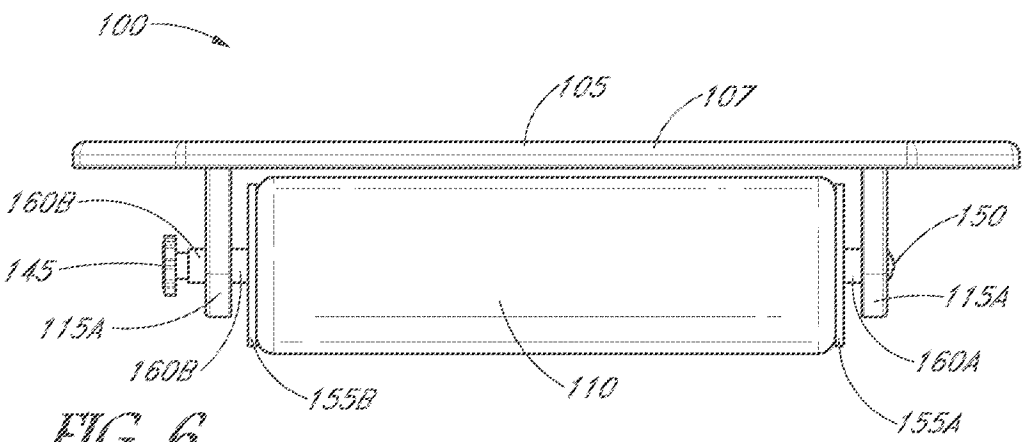
FIG. 6 is a rear view of the exercise device of FIG. 1.
Figure 9:
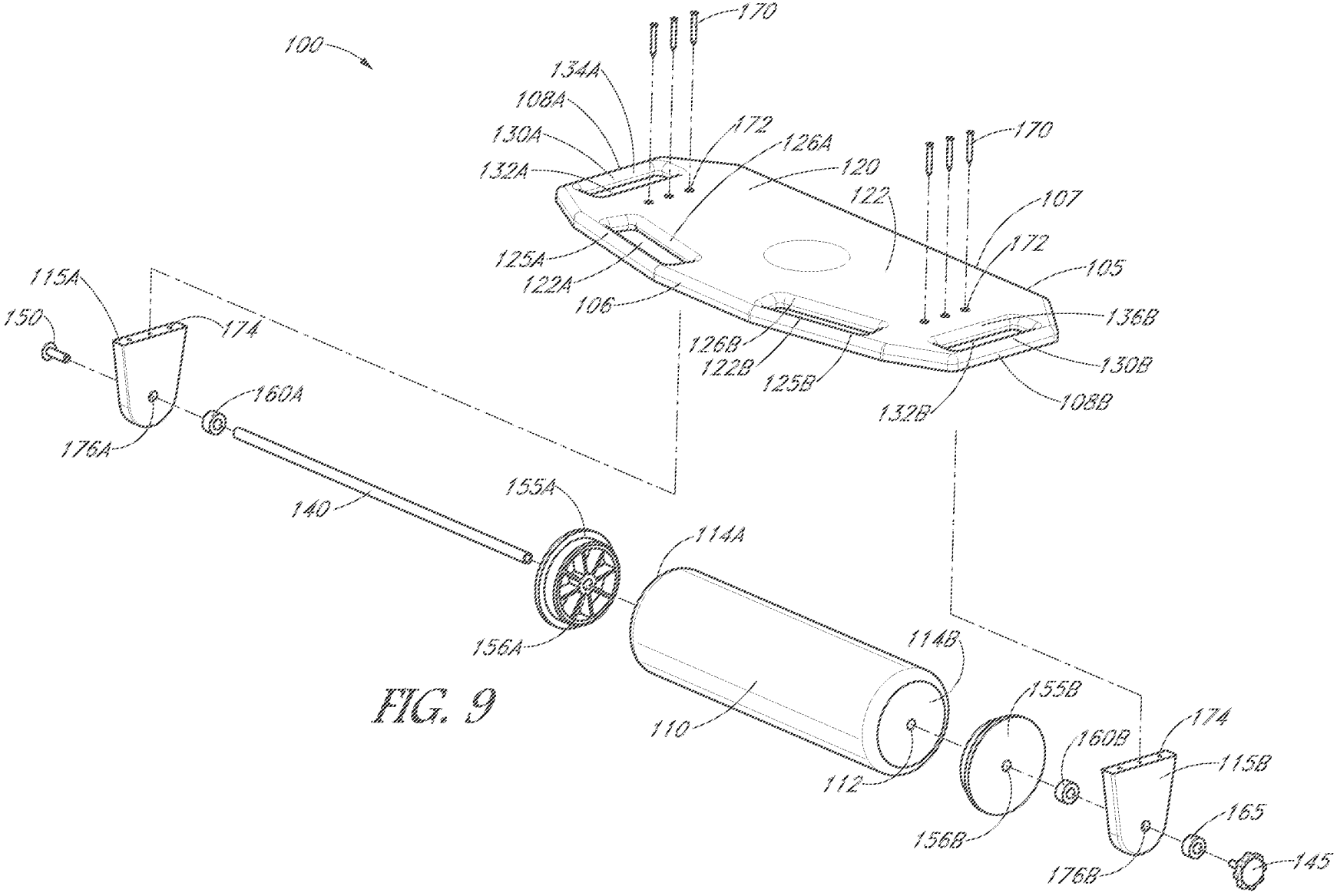
FIG. 9 is an exploded view of the exercise device of FIG. 1

FIG. 1-9 illustrates an embodiment of an exercise device 100. FIG. 1 illustrates a top perspective view of the exercise device 100. FIG. 2 illustrates a bottom perspective view of the exercise device 100. FIG. 3 illustrates a top view of the exercise device 100. FIG. 4 illustrates a bottom view of the exercise device 100. FIG. 5 illustrates a front view of the exercise device 100. FIG. 6 illustrates a rear view of the exercise device 100. FIG. 7 illustrates a first side view of the exercise device 100. FIG. 8 illustrates a second side view of the exercise device 100 taken from the opposite side of FIG. 7. FIG. 9 illustrates an exploded view of the exercise device 100.

With reference to FIG. 1, certain embodiments of the exercise device 100 include a platform 105 and a roller 110. In certain embodiments the roller 110 can be coupled to the platform 105. In certain embodiments, the roller 110 can be coupled to the platform 105 so that the platform 105 can translate in accordance with a direction of rotation of the roller 110 when the roller 110 rotates along a surface, such as the ground. The platform 105 can be positioned and/or supported above the roller 110 when the roller 110 is positioned on a surface.

The platform 105 includes a top surface 120. The top surface 120 may include one or more surface sections 122 configured to receive a body part of a user. The surface sections 122 can support one or more body parts of a user above the roller 110 so that the roller 110 can roll across a surface. The surface sections 122 can be shaped, dimensioned, or otherwise configured to support one or more body parts of a user. In certain embodiments, the one or more surface sections 122 can be shaped, dimensioned, or otherwise configured to support one or more of the forearms, shins, feet, chest, back, sides, and buttocks of the user. The top surface 120 can include 1 surface section 122, 2 surface sections 122, 3 surface sections 122, 4 surface sections 122, 5 surface sections 122, 6 surface sections 122, 7 surface sections 122, 8 surface sections 122, or any other suitable number of surface sections 122. In certain embodiments, the top surface 120 can include a first surface section 122 and a second surface section 122 spaced laterally on opposing sides of a center of the top surface 120. In certain embodiments, the top surface 120 can include a first surface section 122 and a second surface section 122 spaced equidistant from the center of the top surface 120. In certain embodiments, the top surface 120 can include a first surface section 122 configured to support a first forearm, first shin, or first foot of a user and a second surface section 122 configured to support a second forearm, second shin, or second foot of a user.

In certain embodiments, the top surface 120 and/or the one or more surface sections 122 can be flat or substantially flat. In certain embodiments, the one or more surface sections 122 can be formed of or covered in a foam material. In certain embodiments, the foam material can include one or more of polyethylene, ethylene vinyl acetate, and propylene, or any other suitable material. In certain embodiments, the one or more surface sections 122 can be covered in a foam pad. In certain embodiments, the foam pad can be formed of one or more of polyethylene, ethylene vinyl acetate, and propylene, or any other suitable material. In certain embodiments, the one or more surface sections 122 can be formed of one or more elastic or viscoelastic materials, covered in one or more elastic or viscoelastic material, or covered in a pad containing one or more elastic or viscoelastic materials. In certain embodiments, the one or more surface sections 122 can be formed of, covered in, or covered in a pad containing one or more of polyester, polyether, polystyrene, polyurethane, polyethylene, vinyl, or any other suitable polymer-based material.

In certain embodiments, the top surface 120 can be polygonal or generally polygonal. In certain embodiments, the top surface 120 can be rectangular, substantially rectangular, triangular, substantially triangular, elliptical, substantially elliptical, oval, substantially oval, circular, substantially circular, square, substantially square, hexagonal, substantially hexagonal, or any other suitable shape.

The platform 105 includes a front edge 106, a rear edge 107, a first side edge 108A and a second side edge 108B. In certain embodiments, the platform 105 can be elongate. In certain embodiments, an average distance between the side edge 108A and the side edge 108B can be greater than an average distance between the front edge 106 and the rear edge 107. In certain embodiments, an average distance between the side edge 108A and the side edge 108B can be less than an average distance between the front edge 106 and the rear edge 107. In certain embodiments, a distance between a center of the side edge 108A and a center of the side edge 108B can be greater than a distance between a center of the front edge 106 and a center of the rear edge 107. In certain embodiments, a distance between the center of the side edge 108A and the center of the side edge 108B can be less than a distance between the center of the front edge 106 and the center of the rear edge 107. In certain embodiments, a greatest distance between the side edge 108A and the side edge 108B can be greater than a greatest distance between the front edge 106 and the rear edge 107. In certain embodiments, a greatest distance between the side edge 108A and the side edge 108B can be less than a greatest distance between the front edge 106 and the rear edge 107. In certain embodiments, a smallest distance between the side edge 108A and the side edge 108B can be greater than a smallest distance between the front edge 106 and the rear edge 107. In certain embodiments a distance between the front edge 106 and rear edge 107 can be greater at a center of the platform 105 than at the lateral edges of the platform 105. In certain embodiments, a distance between the front edge 106 and the rear edge 107 can decrease between the center of the platform 105 and each of the side edges 108A and 108B.

In certain embodiments, a distance from the center of the edge 108A to the center of the edge 108B can be between 10 inches to 40 inches, between 15 inches to 35 inches, or between 20 inches to 30 inches, or any other suitable range. In certain embodiments, a distance from the center of the edge 108A to the center of the edge 108B can be 10 inches, 12 inches, 14 inches, 16 inches, 18 inches, 20 inches, 22 inches, 24 inches, 26 inches, 28 inches, 30 inches, 32 inches, 34 inches, 36 inches, 38 inches, 40 inches, or any other suitable distances, or a range defined by any two of the preceding values.

In certain embodiments, a distance from the center of the front edge 106 to the center of the rear edge 107 can be between 5 inches to 20 inches, between 7.5 inches to 17.5 inches, between 10 inches to 15 inches, or any other suitable range. In certain embodiments, a distance from the center of the front edge 106 to the center of the rear edge 107 can be 5 inches, 6 inches, 7 inches, 8 inches, 9 inches, 10 inches, 11 inches, 12 inches, 13 inches, 14 inches, 15 inches, 16 inches, 17 inches, 18 inches, 19 inches, 20 inches, or any other suitable distance, or a range defined by any two of the preceding values.

In certain embodiments, the platform 105 includes one or more handles 125. The illustrated embodiment includes two handles 125A-B disposed to receive a user's hands. The one or more handles 125 can be integral with or attached to the platform 105. In certain embodiments, the one or more handles 125 may extend superiorly from the platform 105. In certain embodiments, the one or more handles 125 may be a separate component attached to the platform 125. In certain embodiments, the one or more handles 125 may be integrally formed with the platform 105 or molded as a part of the platform 105. In certain embodiments, the one or more handles 125 may have the shape of a knob, a pull handle, a rod, or any other suitable shape. In certain embodiments, the one or more handles 125 are defined at least partially by a projection, a protrusion, a recess, a slot or an opening.

As shown in FIG. 1, in certain embodiments, the handle 125A can be formed at least partially by a section of the platform 105. In the illustrated embodiment, the handle 125A is configured as an opening 122A for the user's hand to grasp the platform 105. In certain embodiments, the handle 125A can be defined at least partially by a front edge 106 of the platform 105. In certain embodiments, the handle 125A can be a portion of the platform 105 between the front edge 106 of the platform 105 and the opening 122A. The opening 122A can be defined by a front edge 124A and a rear edge 126A. In certain embodiments, the handle 125A can defined by the front edge 106 of the platform 105 and the front edge 124A of the opening 122A. In certain embodiments, the handle can be defined by the rear edge 126A of the opening 122A and a portion of the platform 105 posterior to the opening 122B.

In certain embodiments, the opening 122A can be shaped, dimensioned, or otherwise configured so that the user can extend one or more fingers through the opening 122A while grasping the handle 125A. In certain embodiments, the user grasps the handle 125A by wrapping one or more fingers about the front edge 106 of the platform 105 and the front edge 124A of the opening 122A. In certain embodiments, a user can grasp the handle 125A by inserting one or more fingers through the opening 122A and wrapping the one or more fingers around the rear edge 126A of the opening 122A.

As shown in FIG. 1, in certain embodiments, the handle 125B can be formed at least partially by a section of the platform 105. In certain embodiments, the handle 125B can be defined at least partially by a front edge 106 of the platform 105. In certain embodiments, the handle 125B can be a portion of platform 105 between the front edge 106 of the platform 105 and the opening 122B. The opening 122B can be defined by a front edge 124B and a rear edge 126B. In certain embodiments, the handle 125B can defined by the front edge 106 of the platform 105 and the front edge 124B of the opening 122B. In certain embodiments, the handle can be defined by the rear edge 126B of the opening 122B and a portion of the platform 105 posterior to the opening 122B.

In certain embodiments, the opening 122B can be shaped, dimensioned, or otherwise configured so that a user can extend one or more fingers or sections of a hand through the opening 122B while grasping the handle 125B. In certain embodiments, a user can grasp the handle 125B by wrapping one or more fingers about the front edge 106 of the platform 105 and the front edge 124B of the opening 122B. In certain embodiments, a user can grasp the handle 125B by inserting one or more fingers through the opening 122B and wrapping the one or more fingers around the rear edge 126B of the opening 122B.

In certain embodiments, the platform 105 includes one or more handles 130A-B. As shown in FIG. 1, in certain embodiments, the handle 130A can be formed at least partially by a section of the platform 105. In certain embodiments, the handle 130A can be defined at least partially by a slot or opening 132A. In certain embodiments, the handle 130A can be defined at least partially by a side edge 108A of the platform 105. In certain embodiments, the handle 130A can be a portion of platform 105 between the side edge 108A of the platform 105 and the opening 132A. The opening 132A can be defined by a lateral edge 134A and a medial edge 136A. In certain embodiments, the handle 130A can defined by the side edge 108A of the platform 105 the lateral edge 134A of the opening 132A. In certain embodiments, the handle 130A can be defined by the medial edge 136A of the opening 132A and a portion of the platform 105 medial to the medial edge 136A.

In certain embodiments, the opening 132A can be shaped, dimensioned, or otherwise configured so that a user can extend one or more fingers through the opening 132A while grasping the handle 130A. In certain embodiments, a user can grasp the handle 130A by wrapping one or more fingers about the side edge 108A of the platform 105 and the lateral edge 134A of the opening 132A. In certain embodiments, a user can grasp the handle 130A by inserting one or more fingers through the opening 132A and wrapping the one or more fingers around the medial edge 136A of the opening 132A.

In certain embodiments, the handle 130A may extend superiorly from the platform 105. the handle 130A may be a separate component coupled to the platform 130A. In certain embodiments, the handle 130A may be integrally formed with the platform 105 or molded as a part of the platform 105. In certain embodiments, the handle 130A may have the shape of a knob, a pull handle, a rod, or any other suitable shape.

As shown in FIG. 1, in certain embodiments, the handle 130B can be formed at least partially by a section of the platform 105. In certain embodiments, the handle 130B can be defined at least partially by a slot or opening 132B. In certain embodiments, the handle 130B can be defined at least partially by a side edge 108B of the platform 105. In certain embodiments, the handle 130B can be a portion of platform 105 between the side edge 108A of the platform 105 and the opening 132B. The opening 132B can be defined by a lateral edge 134B and a medial edge 136B. In certain embodiments, the handle 130B can defined by the side edge 108B of the platform 105 the lateral edge 134B of the opening 132B. In certain embodiments, the handle 130B can be defined by the medial edge 136B of the opening 132B and a portion of the platform 105 medial to the medial edge 136B.

In certain embodiments, the opening 132B can be shaped, dimensioned, or otherwise configured so that a user can extend one or more fingers or sections of a hand through the opening 132B while grasping the handle 130B.

In certain embodiments, the opening 132B can be shaped, dimensioned, or otherwise configured so that a user can extend one or more fingers through the opening 132B while grasping the handle 130B. In certain embodiments, a user can grasp the handle 130B by wrapping one or more fingers about the side edge 108B of the platform 105 and the lateral edge 134B of the opening 132B. In certain embodiments, a user can grasp the handle 130B by inserting one or more fingers through the opening 132B and wrapping the one or more fingers around the medial edge 136B of the opening 132B.

In certain embodiments, the handle 130B may extend superiorly from the platform 105. the handle 130B may be a separate component coupled to the platform 130B. In certain embodiments, the handle 130B may be integrally formed with the platform 105 or molded as a part of the platform 105. In certain embodiments, the handle 130B may have the shape of a knob, a pull handle, a rod, or any other suitable shape.

In certain embodiments, the exercise device 100 can include a strap or can attach to a strap. In certain embodiments, the strap can attach to one or more of the handles 125A, 125B, 130A, and 130B. In certain embodiments, a strap can attach to and extend between the handle 130A and the handle 130B. In certain embodiments, the strap can facilitate transportation of the exercise device 100. In certain embodiments, the strap can secure one or more body parts of the user, such as the feet, to the top surface 120 of the platform 105. In certain embodiments, the strap can be a bungee cord, a Velcro® strap, or any other suitable strap.

The roller 110 may be formed of foam, plastic, metal, or any other suitable material. In certain embodiments, the roller 110 may be formed substantially or entirely out of a foam material. In certain embodiments, the roller can be formed of one or more of polyethylene, ethylene vinyl acetate, propylene, or any other suitable material. In certain embodiments, the roller 110 may be a plastic cylinder or a substantially plastic cylinder covered with a layer of foam padding. In certain embodiments, the roller 110 may be a metal cylinder or a substantially metal cylinder covered with a layer of foam padding.

In certain embodiments, the roller 110 is generally cylindrical. In certain embodiments, the roller 110 includes a lumen 112 extending through the roller 110. The lumen 112 can extend from a first end 114A of the roller 110 to a second end 114B. In certain embodiments, the lumen 112 can extend through a central axis or axis of rotation of the roller 110. In certain embodiments, the ends 114A and 114B can be flat or substantially flat.

The lumen 112 can be shaped, dimensions, or otherwise configured to receive a rod or shaft 140. The shaft 140 can be shaped, sized, or otherwise dimensioned to extend through the lumen 112 of the roller 110. The shaft 140 can act as an axle for the roller 110. In certain embodiments, the shaft 140 can be secured or fixed within the roller 110 such that the roller 110 rotates with the shaft 140.

The roller 110 can be rotatably coupled to the platform 105 such that the roller 110 can rotate relative to the platform 105 about the central axis of the roller 110. In certain embodiments, the platform 105 can be supported above the roller 110. As described herein, the platform 105 can support one or more body parts of a user. In certain embodiments, the platform 105 and one or more body parts of a user can be supported above the roller 110.

In certain embodiments, the platform 105 can rotate about the roller 110. In certain embodiments, the platform 105 can rotate about the central axis of the roller 110. In certain embodiments, rotation of the platform 105 about the roller 110 can be independent from rotation of the roller 110. In certain embodiments, the platform 105 can rotate or tilt fore and aft from a position above the roller 110. In certain embodiments, the platform 105 can rotate or tilt fore and aft while the roller 110 is rolling across a surface. In certain embodiments, the platform 105 can rotate or tilt fore and aft while supporting a user above the roller 110. In certain embodiments, the platform 105 can be coupled to the roller 110 so that the platform 105 rotates or tilts fore or aft if the weight of a body part or body parts of a user positioned on the platform 105 is not balanced over the roller 110. For example, in certain embodiments, the platform 105 can rotate forward about the roller 110 if the weight of any body parts of the user on the surfaces 122 of the platform 105 are unevenly distributed towards the front edge 106 of the platform 105 over the roller 110. In certain embodiments, the platform 105 can rotate rearward if the weight of any body parts of the user on the surfaces 122 of the platform 105 are unevenly distributed towards the rear edge 107 of the platform 105 over the roller 110.

In certain embodiments, the exercise device 100 can include a pair of supports 115A-B. The supports 115A-B can couple the platform 105 with the roller 110. In certain embodiments, the roller 110 is rotatably coupled to the platform 105 via the supports 115A-B. The roller 110 can rotate relative to the supports 115A-B about the central axis of the roller 110. In certain embodiments, the supports 115A-B can support the platform 105 above the roller 110. In certain embodiments, the supports 115A-B can support the platform 105 and the weight of a user or a body part of a user above the roller 110. In certain embodiments, the supports 115A-B can couple the platform 105 to the roller 110 so that the platform 105 can rotate about the roller 110. In certain embodiments, the supports 115A-B can couple the platform 105 to the roller 110 so that the platform 105 can rotate about the central axis of the roller 110. In certain embodiments, the supports 115A-B can couple the platform 105 to the roller 110 so that rotation of the platform 105 about the roller 110 can be independent from rotation of the roller 110. In certain embodiments, the supports 115A-B can couple the platform 105 to the roller 110 so that the platform 105 can rotate or tilt fore and aft from a position above the roller 110. In certain embodiments, the supports 115A-B can couple the platform 105 to the roller 110 so that the platform 105 can rotate or tilt fore and aft while the roller 110 is rolling across a surface. In certain embodiments, the supports 115A-B can couple the platform 105 to the roller 110 so that the platform 105 can rotate or tilt fore and aft while supporting a user above the roller 110. In certain embodiments, the supports 115A-B can couple the platform 105 to the roller 110 so that the platform 105 rotates or tilts fore or aft if the weight of a body part or body parts of a user positioned on the platform 105 is not balanced over the roller 110.

As shown in FIG. 9, in certain embodiments, the supports 115A and 115B can include openings 176A and 176B, respectively. The openings 176A-B can extend through side surfaces of the supports 115A and 115B. The openings 176A and 176B are dimensioned, shaped, or otherwise configured to receive the shaft 140. In certain embodiments, each of the openings 176A-B can act as a bushing to the shaft 140. The shaft 140 can be rotatably coupled to or mounted in the openings 176A and 176B. The openings 176A and 176B can be dimensioned, shaped, or otherwise configured to allow the shaft 140 to rotate within the openings 176A and 176B such that the shaft 140 and roller 110 can rotate relative to the supports 115A and 115B and the platform 105. In certain embodiments, the openings 176A and 176B can include bearings, such as ball bearings, to facilitate rotation of the shaft 140 within the openings 176A and 176B.

In certain embodiments, the openings 176A and 176B can be positioned so that the roller 110 is spaced apart from a bottom surface 135 of the platform 105. In certain embodiments, a distance between the bottom surface 135 of the platform 105 and the roller 110 can be 0.25 inches, 0.5 inches, 0.75 inches, 1 inch, 1.25 inches, 1.5 inches, 1.75 inches, 2.0 inches, 2.25 inches, 2.5 inches, 2.75 inches, 3 inches, 3.25 inches, 3.5 inches, 3.75 inches 4.0 inches, 4.25 inches, 4.5 inches, 4.75 inches, 5 inches, or any other suitable distance, or a range defined by any two of the preceding values.

As shown in FIG. 2, the supports 115A-B can extend from the bottom surface 135 of the platform 105. In certain embodiments, the supports 115A-B can be integrally formed with or molded as a part of the platform 105. In certain embodiments, the supports 115A-B may be separate components that attach to the platform 105. In certain embodiments, each supports 115A-B can be secured to the platform 105 by one or more fasteners 170. The fasteners 170 can be screws, bolts, or any other suitable fastener. In certain embodiments the fasteners 170 can extend through openings 172 in the top surface 120 of the platform 105 and into openings 174 in the supports 115A-B. The openings 174 can be threaded and configured to engage a threaded body of the fasteners 170.

In certain embodiments, the exercise device 100 can include a pair of end caps 155A and 155B. The end cap 155A can couple to the end 114A of the roller 110. The end cap 155B can couple to the end 114B of the roller 110. The end cap 155A can include an opening 156A configured to receive the shaft 140. The end cap 155B can include an opening 156B configured to receive the shaft 140. In certain embodiments, each opening 156A-B can act as a bushing to the shaft 140. The shaft 140 can be rotatably coupled to or mounted in the openings 156A and 156B. In certain embodiments, the openings 156A and 156B can be dimensioned, shaped, or otherwise configured to allow the shaft 140 to rotate within the openings 156A and 156B such that the shaft 140 and roller 110 can rotate relative to the supports end caps 155A-B. In certain embodiments, the openings 156A and 156B can include bearings, such as ball bearings, to facilitate rotation of the shaft 140 within the openings 156A and 156B. In certain embodiments, the end caps 155A-B can be secured to the roller 110 such that the end caps 155A-B rotate with the roller 110.

In certain embodiments, the end caps 155A-B can provide structural support to the roller 110. The end caps 155A-B may also provide support to the shaft 140 extending through the end caps 155A-B.

In certain embodiments, the exercise device 100 can include a fastener 150. The fastener 150 can secure to the shaft 140. In certain embodiments, the shaft 140 is hollow. The fastener 150 can be received in a lumen extending through the shaft 140. As shown in FIG. 9, the fastener 150 can be a bolt. The fastener 150 can be secured to the shaft 140 to restrict movement of the shaft 140 in at least one direction. For example, in certain embodiments, the fastener 150 can include a head having a circumference larger than that of the opening 176A. The fastener 150 can prevent movement of the shaft in a direction medial from the support 115A.

In certain embodiments, the exercise device 100 can include a fastener 145. The fastener 145 can secure to the shaft 140. The fastener 145 can be received in a lumen extending through the shaft 140. As shown in FIG. 9, the fastener 145 can be a knob. The fastener 145 can be secured to the shaft 140 to restrict movement of the shaft 140 in at least one direction. For example, in certain embodiments, the fastener 145 can include a head having a circumference larger than that of the opening 176B. The fastener 145 can prevent movement of the shaft in a direction medial from the support 115B.

In certain embodiments, the fastener 145 can be removed to facilitate removal of the shaft 140 and roller 110 from the supports 115A and 115B. In certain embodiments, the fastener 145 can be removed to facilitate removal of the shaft 140 and the roller 110 from the platform 105.

In certain embodiments, the roller 110 and/or shaft 140 can be coupled to the platform 105 and/or supports 115A-B via a quick connect coupling. A quick connect coupling can facilitate engagement and disengagement of the roller 110 and/or shaft 140 from the platform 105 and/or supports 115A-B, for example, to replace the roller 110 with an alternate roller.

In certain embodiments, the exercise device 100 can include a washer 160A between the support 115A and the end cap 155A. In certain embodiments, the exercise device 100 can include a washer 160B between the support 115B and the end cap 155B. In certain embodiments, the exercise device 100 can include a washer 165 between the support 115B and the knob 145.

In certain embodiments, multiple rollers 110 may be provided. For example, in certain embodiments, the exercise device 100 can include 2, 3, 4, 5, 6, or any other suitable number of rollers 110. In certain embodiments, multiple rollers 110 may share a common central axis. In certain embodiments, multiple rollers 110 can be coupled to the shaft 140. In certain embodiments, the platform 105 can rotate about a common central axis of the multiple rollers 110. The platform 105 can rotate or tilt fore and aft from a position above the multiple rollers 110. In certain embodiments, the platform 105 can rotate or tilt fore and aft while the multiple rollers 110 are rolling across a surface. In certain embodiments, the platform 105 can rotate or tilt fore and aft while supporting a user above the multiple rollers 110.

In use, the roller 110 can be rolled along a surface to cause the platform 105 to translate relative to the surface. The roller 110 can be rolled along a surface to cause the platform 105 to translate relative to the surface while a body part of a user is position on the platform 105 above the roller 110. In certain embodiments, the platform 105 can rotate or tilt fore and aft while a body part of a user in positioned on the platform 105 above the roller 110. In certain embodiments, the platform 105 can be coupled to the roller 110 so that the platform 105 rotates or tilts fore or aft if the weight of a body part or body parts of a user positioned on the platform 105 is not balanced over the roller 110. The possibility of rotation of the platform 105 may require a user to maintain a balance of one or more body parts over the roller 110 or to adjust a balance of one or more body parts over the roller 110 to prevent rotation or tilting of the platform 105. For certain exercises, maintaining a balance of one or more body parts over the roller 110 or adjusting the balance of one or more body parts over the roller 110 can engage core muscles and stabilizer muscles of a user.

The exercise device 100 can be used for a variety of different exercise techniques. Certain exercise techniques can involve translation of the exercise device 100 and/or balancing over the roller 110 of the exercise device 100.

In certain embodiments, with the roller 110 positioned over a ground surface, a user can position their shins on one or more surfaces 122 of the platform 105. The user can balance their body weight over the roller 110. The user can place their hands or forearms anterior to the exercise device 100 on the ground surface and translate the exercise device 100 in a posterior direction to enter a stretched plank position. A stretched plank position can engage the core, shoulders, lower back, and stabilizer muscles of the user. From the stretched plank position, the user can translate the exercise device 100 in the anterior direction to enter a crunch position. A crunch position can engage lower abdominal muscles, middle abdominal muscles, upper abdominal muscles, chest muscles, rear shoulder muscles, back muscles, and thigh muscles of the user.

In certain embodiments, with the roller 110 positioned over a ground surface, a user can position their body sideways over the roller 110, placing one forearm on the ground surface, and placing the side of one shin over a surface 122 of the platform 105. The user can then roll the platform in a posterior direction to enter a side plank position. The side plank position requires the user to use external oblique muscles, serratus anterior muscles, abdominal core muscles, shoulder muscles, and buttocks muscles. The side plank position can require constant use of the stabilizer muscles.

In certain embodiments, with the roller 110 positioned over a ground surface, a user can position their body so that their back is lying on the ground surface and their knees are bent. The user can position the roller 110 under the feet. With the feet on one or more of the surfaces 122 of the platform 105, the user can push the buttocks off the ground surface in a superior direction. This position can engage the buttocks muscles, abdominal core muscles, and stabilizing muscles. While in the aforementioned position, the user can push the exercise device 100 away from the body in an anterior direction and then pull the exercise device 100 back towards the body in the posterior direction using the feet in order to exercise the hamstrings, glutes, calves, lower back, and dorsa flexors.

In certain embodiments, with the roller 110 positioned over a ground surface, a user can place both knees on the ground surface, position both forearms on one or more of the surface areas 122 of the platform 105, and grasp the handles 125A and 125B. The user can balance their upper body weight over the roller 110. The user can push the board away from the body in an anterior direction to engage the abdominal core muscles, shoulder muscles, forearm muscles, hand muscles, buttocks, thigh muscles, mid-back muscles, lower back muscles, and stabilizer muscles.

In certain embodiments, the top surface 120 of the exercise device 100 can be placed over the ground surface. The roller 110 can be used as a stationary body roller. In certain embodiments, the roller 110 can be used for muscle recovery, massage, stretching of the lower back, stretching of the mid-back, stretching of the upper back, and/or physical therapy. In certain embodiments, the roller 110 can be used to perform myofascial release therapy. In certain embodiments, a user can perform a core strengthening roll by maintaining the back in a straight configuration and rolling the back backwards and forwards on the roller 110 while tightening the core abdominal muscles. The core strengthening role can require the body to constantly engage the stabilizer muscles to balance on the roller.

In contrast to non-stationary body rollers, when the roller 110 is used as a stationary body roller, the roller 110 can be maintained at a fixed height with space below the roller 110 so that the roller 110 can roll freely. As a stationary body roller, the roller 110 can remain in a single position relative to the ground during the duration of an exercise. In certain embodiments, a gap between the roller 110 and the bottom surface 135 of the platform 105 can prevent hair or clothing from being caught beneath the roller 110 when the roller 110 is used as a stationary body roller. When used as a stationary body roller, the roller 110 can be used on any surface, including carpet, hard floors, hardwood, dirt, grass, sand, concrete, cement, asphalt, or any other surface. In certain embodiments, using the roller 110 as a stationary roller can allow body rolling without the roller picking up dirt or debris from the ground surface.

Figure 10:
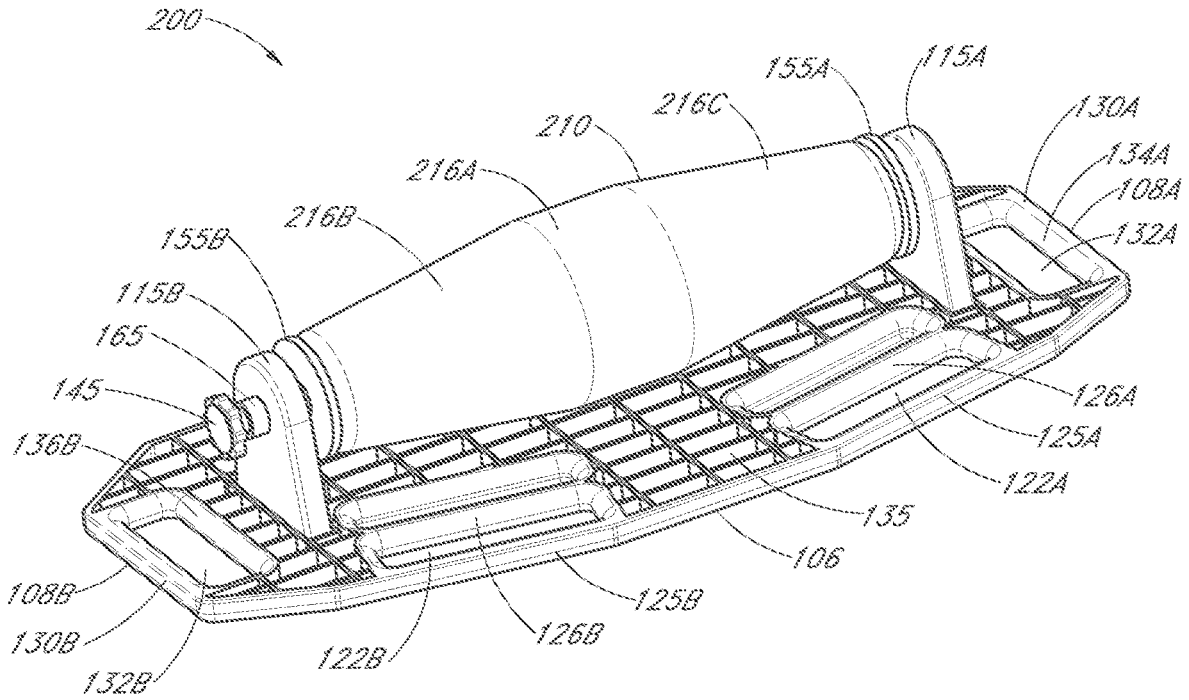
FIG. 10 is a bottom perspective view of an exercise device according to another preferred embodiment of the present invention.

FIG. 10 illustrates an embodiment of an exercise device 200. The exercise device 200 can include any of the same or similar features and functions as the exercise device 100. As shown in FIG. 10. The exercise device 200 includes a roller 210. The roller 210 can include a cylindrical or substantially cylindrical portion 216A. As shown in FIG. 10, the roller 210 can also include a first tapered portion 216B and a second tapered portion 216C.

In certain embodiments, the cylindrical portion 216A can extend over 5%, 10%, 15%, 20%, 25%, 30%, 35%, 40%, 45%, 50%, 55%, 60%, or any other suitable percentage of the length of the roller 210, or over a range defined by any two of the preceding values.

The tapered portion 216B can taper between the cylindrical portion 216A towards the support 115B. In certain embodiments, the tapered portion 216B can taper from a first diameter proximal the cylindrical portion 216A to a second diameter distal from the cylindrical portion 216A. In certain embodiments, the first diameter of the tapered portion 216B can be greater than the second diameter of the tapered portion 216B. In certain embodiments, second diameter of the tapered portion 216B can be 30%, 40%, 50%, 60%, 70%, 80%, 90%, or any other suitable percentage of the first diameter of the tapered portion 216B.

The tapered portion 216C can taper between the cylindrical portion 216A towards the support 115A. In certain embodiments, the tapered portion 216C can taper from a first diameter proximal the cylindrical portion 216A to a second diameter distal from the cylindrical portion 216A. In certain embodiments, the first diameter of the tapered portion 216C can be greater than the second diameter of the tapered portion 216C. In certain embodiments, second diameter of the tapered portion 216C can be 30%, 40%, 50%, 60%, 70%, 80%, 90%, or any other suitable percentage of the first diameter of the tapered portion 216C.

In use, with the roller 210 positioned over a ground surface, a user can adjust their weight over the platform 105 to change the section of the roller 210 contacting the ground surface between the sections 216A, 216B, and 216C. When the section 216A is in contact with the ground surface, the shape of section 216A can facilitate anterior and posterior movement of the exercise device 200. When the section 216B is in contact with the ground surface, the shape of section 216B can facilitate movement in an anterior and lateral direction and in a posterior and medial direction. When the section 216C is in contact with the ground surface, the shape of section 216C can facilitate movement in an anterior and lateral direction and in a posterior and medial direction.

In certain embodiments, there is no cylindrical portion 216A, and first tapered portion 216B and second tapered portion 216C can each extend from a center of the roller 210. In certain embodiments, a roller 210 can include a single tapered portion 216B extending from along the entire length of the roller 210. The tapered portion 216B can taper from a largest diameter nearest to the support 115A to a smallest diameter nearest to the support 115B. In certain embodiments, a roller 210 can include a single tapered portion 216C extending the entire length of the roller 210. The tapered portion 216C can taper from a largest diameter nearest to the support 115A to a smallest diameter nearest to the support 115B.

In certain embodiments, a user can use the exercise device 200 with either the section 216B of the roller or the section 216C of the roller in contact with a ground surface to exercise the oblique muscles.

In certain embodiments, the exercise device 200 can include a quick connect coupling. The roller 210 can be coupled to the platform 105 and/or supports 115A-B via a quick connect coupling. A quick connect coupling can facilitate engagement and disengagement of the roller 210 from the platform 105 and/or supports 115A-B, for example, to replace the roller 210 with an alternate roller. For example, in some embodiments, the roller 210 can be disconnected and replaced with the roller 110. In certain embodiments, the roller 110 can be disconnected and replaced with the roller 210.

While the above detailed description has shown, described, and pointed out novel features of the development as applied to various embodiments, it will be understood that various omissions, substitutions, and changes in the form and details of the devices illustrated may be made by those skilled in the art without departing from the spirit of the development. As will be recognized, the present development may be embodied within a form that does not provide all of the features and benefits set forth herein, as some features may be used or practiced separately from others. All changes which come within the meaning and range of equivalency of the claims are to be embraced within their scope.

The foregoing description details certain embodiments of the systems, devices, and methods disclosed herein. It will be appreciated, however, that no matter how detailed the foregoing appears in text, the systems, devices, and methods may be practiced in many ways. As is also stated above, it should be noted that the use of particular terminology when describing certain features or aspects of the invention should not be taken to imply that the terminology is being re-defined herein to be restricted to including any specific characteristics of the features or aspects of the technology with which that terminology is associated.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment may be included with other depicted embodiments in any combination. For example, any of the various components described herein and/or depicted in the Figures may be combined, interchanged or excluded from other embodiments.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The term "comprising" as used herein is synonymous with "including," "containing," or "characterized by," and is inclusive or open-ended and does not exclude additional, unrecited elements or method steps.

The above description discloses several methods of manufacture and materials of the present development. This development is susceptible to modifications in the methods and materials, as well as alterations in the fabrication methods and equipment. Such modifications will become apparent to those skilled in the art from a consideration of this disclosure or practice of the development disclosed herein. Consequently, it is not intended that this development be limited to the specific embodiments disclosed herein, but that it cover all modifications and alternatives coming within the true scope and spirit of the development as embodied in the attached claims.

While the above detailed description has shown, described, and pointed out novel features of the improvements as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others. The scope of the invention is indicated by the appended claims rather than by the foregoing description. All changes which come within the meaning and range of equivalency of the claims are to be embraced within their scope.

What is claimed is:

1. A method of using a non-motorized exercise device on a ground surface, the method comprising:

providing a single cylindrical roller and a platform supported above the single cylindrical roller, the single cylindrical roller being coupled to the platform and translationally fixed relative to the platform, the platform having a long axis lying in a horizontal plane and a short axis lying in the horizontal plane;

rotating the single cylindrical roller of the non-motorized exercise device relative to the platform about an axis;

rolling the single cylinder roller of the non-motorized exercise device across the ground surface; and tilting the platform in fore and aft directions while the single cylindrical roller rolls across the ground surface and rotates about the axis.

2. The method of claim 1, wherein the platform comprises at least one handle.

3. The method of claim 2, wherein the at least one handle is defined by an opening in the platform.

4. The method of claim 1, wherein tilting the platform in the fore and aft directions is about the axis of the single cylindrical roller.

5. The method of claim 4, further comprising contacting an edge of the platform and the single cylindrical roller with the ground surface when the platform is tilted in the fore and aft directions.

6. A method of using a non-motorized exercise device on a ground surface, the method comprising:

providing a platform having a long axis lying in a horizontal plane and a short axis lying in the horizontal plane, the platform having a surface sized and shaped to support a body part of a user and a pair of handles, the pair of handles comprising a first handle and a second handle;

providing a single cylindrical roller translationally fixed relative to the platform and configured to rotate relative to the platform about an axis, the axis being parallel to the long axis of the platform;

translating the platform in a first direction while the single cylindrical roller supports the platform above the ground surface;

rotating the single cylindrical roller of the non-motorized exercise device in a first direction of rotation;

translating the platform in a second direction; and rotating the single cylindrical roller of the non-motorized exercise device in a second direction of rotation.

7. The method of claim 6, wherein the first handle is defined by a front edge of a first opening and a front edge of the platform and the second handle is defined by a front edge of a second opening and the front edge of the platform.

8. The method of claim 6, wherein the platform further comprises a second pair of handles.

9. The method of claim 8, wherein the second pair of handles comprises a third handle at least partially defined by a third opening in the platform and a fourth handle at least partially defined by a fourth opening in the platform.

10. The method of claim 6, wherein the platform further comprises a pair of supports configured to support the single cylindrical roller away from the platform.

11. The method of claim 10, wherein the platform further comprises a shaft configured to be received in an opening of each support.

12. The method of claim 11, further comprising rotating the shaft within the opening of each support.

13. The method of claim 6, further comprising tilting the platform in fore and aft directions while the single cylindrical roller rolls across the ground surface and rotates about the axis.

14. The method of claim 13, wherein tilting the platform in the fore and aft directions is about the axis of the single cylindrical roller.

15. A method of using a non-motorized exercise device on a ground surface, the method comprising:

providing a platform having a long axis lying in a horizontal plane and a short axis lying in the horizontal plane, the platform comprising:

a surface sized and shaped to receive a body part of a user, and a single cylindrical roller translationally fixed relative to the platform and configured to rotate relative to the platform about an axis, the axis being parallel to the long axis of the platform;

translating the platform in a first direction;

rotating the single cylindrical roller of the non-motorized exercise device in a first direction of rotation;

translating the platform in a second direction; and rotating the single cylindrical roller of the non-motorized exercise device in a second direction of rotation.

16. The method of claim 15, wherein the platform comprises at least one handle.

17. The method of claim 16, wherein the at least one handle is defined by an opening in the platform.

18. The method of claim 17, wherein the at least one handle is defined by a front edge of the platform and a front edge of the opening.

19. The method of claim 15, further comprising rotating a shaft within a lumen of the single cylindrical roller.

20. The method of claim 19, further comprising rotating the shaft within an opening of a support that extends from the platform.

21. A method of using an exercise device on a ground surface, the method comprising:

providing a platform having a long axis lying in a horizontal plane and a short axis lying in the horizontal plane, the platform having a surface sized and shaped to support a body part of a user and a pair of handles, the pair of handles comprising a first handle and a second handle;

providing a single cylindrical roller translationally fixed relative to the platform and configured to rotate relative to the platform about an axis, the axis being parallel to the long axis of the platform;

translating the platform in a first direction while the single cylindrical roller supports the platform above the ground surface;

rotating the single cylindrical roller in a first direction of rotation;

translating the platform in a second direction; and rotating the single cylindrical roller in a second direction of rotation, wherein the platform further comprises a second pair of handles, and wherein the second pair of handles comprises a third handle at least partially defined by a third opening in the platform and a fourth handle at least partially defined by a fourth opening in the platform.

* * * * *